United States Patent [19]

Mieyal et al.

[11] Patent Number: 4,696,142

[45] Date of Patent: Sep. 29, 1987

[54] SUSPENSION CEILING WITH SNAP-UP PANELS

[75] Inventors: David F. Mieyal, Strongsville; Gerald L. Koski, Parma, both of Ohio

[73] Assignee: Donn Incorporated, Westlake, Ohio

[21] Appl. No.: 911,773

[22] Filed: Sep. 26, 1986

[51] Int. Cl.[4] ..... E04B 5/57

[52] U.S. Cl. ..... 52/762

[58] Field of Search ..... 52/762, 484, 145, 630, 52/488, 482, 766

[56] References Cited

U.S. PATENT DOCUMENTS

| | | | |
|---|---|---|---|
| 2,227,452 | 1/1941 | Jullien | 52/767 |
| 2,662,745 | 12/1953 | Jorn | 52/767 |
| 2,734,446 | 2/1956 | O'Day | 98/40 |
| 3,021,915 | 2/1962 | Kemp | 52/145 |
| 3,164,230 | 1/1965 | Adams . | |
| 3,277,622 | 10/1966 | Jensen | 52/222 |
| 3,461,630 | 8/1969 | Lovullo | 52/762 |
| 3,550,341 | 12/1970 | Thompson | 52/488 |
| 3,581,453 | 6/1971 | Jones . | |
| 4,021,986 | 5/1977 | McCall et al. | 52/475 |
| 4,086,480 | 4/1978 | Lahm | 362/148 |
| 4,109,438 | 8/1978 | De la Concha | 52/630 |
| 4,206,578 | 6/1980 | Mieyal | 52/730 |

FOREIGN PATENT DOCUMENTS

| | | | |
|---|---|---|---|
| 1191401 | 5/1970 | United Kingdom | 52/484 |

*Primary Examiner*—John E. Murtagh

*Attorney, Agent, or Firm*—Pearne, Gordon, McCoy & Granger

[57] ABSTRACT

A snap-up panel for suspension ceiling systems is disclosed. The panel is formed of sheet metal and provides a central planar section and four upwardly extending flanges along the edges of the planar section. Each flange is formed with an inwardly directed rib extending along the length of the flange at a point spaced from the upper and lower edges thereof. Detents are provided in the flanges adjacent to the corners and are positioned in alignment with the ribs and sized to project beyond the inner extremity of the ribs. These detents provide additional support for the panel when the ribs are snapped over supporting lips in a suspension ceiling grid system. Improved alignment and support of the panels are provided by the detents when the panels are installed in a suspension ceiling grid.

9 Claims, 6 Drawing Figures

SUSPENSION CEILING WITH SNAP-UP PANELS

BACKGROUND OF THE INVENTION

This invention relates generally to suspension ceiling systems, and more particularly to a novel and improved snap-up panel or pan for use in such systems.

PRIOR ART

Suspension ceiling systems often include grid runners or tees which provide oppositely extending panel supporting flanges. In such systems, the peripheries of panels extend over flanges to support the panels. Such panels are installed by laying them in the panel opening, and therefore such panels are often referred to as "lay-in" panels. Examples of such systems are illustrated in U.S. Pat. Nos. 4,021,986; 4,086,480; and 4,206,578.

It is also known to provide suspension ceiling systems in which the grid members provide downwardly directed channels structured to grip the upstanding edges of metal pans or panels. Such pan-type panels are usually installed by snapping the flanges up into the grid member channel, and are therefore generally referred to as "snap-up pans" or "snap-up panels." Examples of such suspension systems for snap-up pans are illustrated in U.S. Pat. Nos. 2,734,446; 3,164,230; 3,277,622; and 3,581,453.

Further, the copending application Ser. No. 803,729, filed Dec. 2, 1985 (assigned to the assignee of the present invention), discloses a suspension ceiling system combining snap-up pans and grid tees of the type illustrated in U.S. Pat. No. 4,021,986, supra. In such copending application, the disclosed ceiling system also combines such snap-up panels with lay-in panels. Such copending application is incorporated herein by reference.

Grid tees of the type illustrated in such copending application are generally formed by roll-forming elongated strips of sheet metal to the cross section of the final grid. After roll-forming the long strips of metal to such required shapes, it is customary to cut the strips in discrete lengths and to provide end connectors so that the lengths of runners can be assembled in a grid defining panel receiving openings. Such openings are generally polygonal and usually are rectangular or square.

When rolling such runners, residual stresses exist in the material forming the runners that cause what is often referred to as a "lead to trail" distortion when the continuously rolled product is cut in discrete lengths. For example, grid runners having a cross section as illustrated in the copending application, supra, provide a substantially rectangular channel along the lower edge of the runner. Such channel is defined in part by inwardly directed, opposed and spaced lips which cooperate to define a downwardly directed opening extending lengthwise of the channel. When the roll-formed strip is cut into discrete lengths, there is a tendency for the end of the channel on one side of the cut to distort a small amount so that the spacing between the inturned lips is greater than the spacing that exists at locations spaced from the ends of the runner. Such spreading of the inturned lips tends to occur to a greater extent at the end of the runner which was first formed by the rolling process. On the other hand, the trailing end of the runner, when considering the roll forming process, does not tend to exhibit such spreading of the inturned lips.

In any event, such runners have small variations along their length, with at least one end of the runner normally providing an increased spacing between the inturned lips.

In addition, it is virtually impossible to install a grid so that the openings therein are exactly rectangular, or square, as the case may be. Consequently, even carefully manufactured and installed grids have openings which are out-of-square to some extent. Therefore, when a die-formed snap-up panel which is vertically exactly square or rectangular is installed in an opening and does not exactly match the shape of the opening, localized stresses tend to be produced in the panel which are transmitted into the base of the panel and produce irregularities, sometimes referred to as "oil-canning." Still further, such mismatching can result in misalignment between adjacent panels which is visually apparent along the edges of panels.

SUMMARY OF THE INVENTION

In accordance with the present invention, a novel and improved suspension ceiling snap-up pan or panel is provided with a supporting rib extending along the sides thereof in combination with supporting and positioning detents symmetrically arranged adjacent to each corner. These detents cooperate with the ribs to provide proper support even when the spacing between associated supporting lips on the grid vary from one location to another. Still further, such detents cooperate to center and align panels so that the panels are properly positioned with respect to each other, even when the grid opening in which the panels are installed is out-of-square to some extent. Additionally, such detents provide improved support without creating difficulty in removing panels from an assembled ceiling when access is required to the area above the suspended ceiling.

In the illustrated embodiment, the pans or panels are formed of sheet metal having a planar surface surrounded by upwardly extending supporting flanges. Ribs are formed in the upstanding flanges which snap over associated lips provided by the assembled grid to secure the panels in the installed position. Detents are formed in the upwardly extending flanges substantially adjacent to each end thereof. The detents provide additional supporting and locating projections on both sides of each corner.

The panels are preferably formed by die-cutting the panel sheet metal while in a flat state. Preferably, the ribs and detents are simultaneously formed during the die cutting operation. Subsequently, the panel edges are die-bent up to form the required flanges. Such flanges in an installed ceiling system give the appearance of substantial panel depth. With the illustrated embodiment, proper support and alignment are achieved without encountering oil-canning or difficulty during installation or during removal of an installed panel when access to the zone above the ceiling is required.

These and other aspects of this invention are illustrated in the accompanying drawings, and are more fully described in the following specification.

DETAILED DESCRIPTION OF THE DRAWINGS

Figure 1:
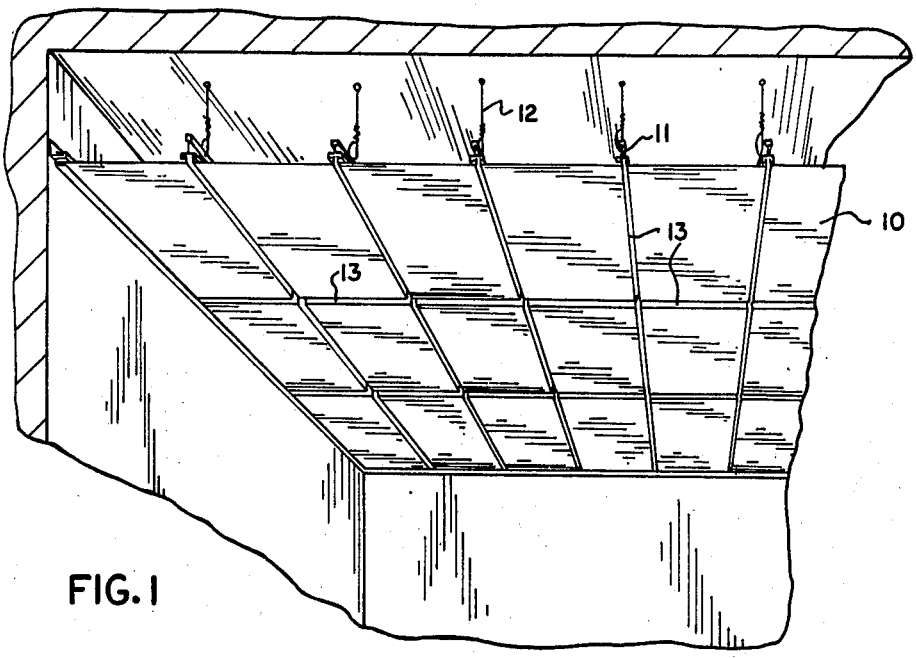
FIG. 1 is a perspective view of a portion of an assembled suspension ceiling in accordance with the present invention.

FIG. 1 illustrates a portion of an assembled suspension ceiling incorporating snap-up panels or pans 10 in accordance with the present invention. In such a system, grid runners 11, discussed in greater detail below, are interconnected to form panel-receiving openings and are suspended from a building structure by wire hangers 12 or the like.

In the illustrated embodiment, the edges of adjacent panels 10 are spaced apart a small distance 13. As best illustrated in FIG. 1, the spacing 13 between adjacent panels produces a visual array consisting of perpendicularly extending lines. It is important that the adjacent panels be accurately positioned within the grid so that the extended lines, when viewed from below, are as straight as possible, even if the grid is assembled slightly out-of-square. For example, if one panel is not directly aligned both laterally and lengthwise, the lines produced by the spaces will either be wavy or uneven. A condition of waviness or unevenness is highly objectionable because it is quite apparent to view from underneath the ceiling, particularly in large rooms where the ceiling is visible for an extended distance. In accordance with the present invention, proper positioning of the panels so that the spaces 13 are in virtually perfect alignment is achieved even when the grid is out-of-square to some extent.

Figure 2:
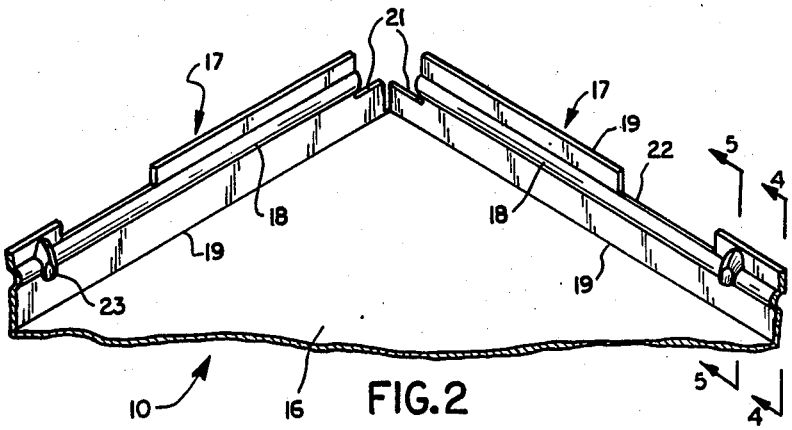
FIG. 2 is a fragmentary, perspective view of one corner of a preferred panel in accordance with the present invention.

FIG. 2 illustrates the structural detail of a panel adjacent to one corner thereof. It should be understood that the panels 10 are usually either rectangular or square. It should also be understood that the structure adjacent to each corner is the same as the structure illustrated in FIG. 2. The panel 10 includes a planar, central portion 16 of rectangular or square shape, and is provided with upstanding flanges 17 along the four sides of the central planar portion 16. Each of the flanges is provided with an upwardly extending rib 18 which extends substantially the entire length of the associated flange 17 at a location spaced from and substantially parallel to the bend 19 joining each flange with the central planar portion 16. Such rib 18 is also spaced a small distance from the free edge 20 of the associated flange 17;. Each end of each upstanding flange 17 is provided with a notched-out portion 21 to provide clearance for the inturned lips of runners extending through intersections. Further, substantially adjacent each corner the upper portion of the flange is notched out at 22 to receive a tool for removing the panel from its installed position when access to the zone above the ceiling is required. The tool receiving notch 22 and the end notches 21 are disclosed and claimed in the copending application Ser. No. 803,729, supra. The panel thus far described is identical to the panel disclosed and claimed in such copending application.

In accordance with the present invention, an inwardly extending detent or projection 23 is provided at each end of each upstanding flange 17 substantially adjacent to the notch 22. Such detent in the illustrated embodiment is located within three inches of the corner itself. The detent has a shape best illustrated in FIGS. 5 and 6, and extends inwardly to an inner extremity 24 beyond the inner extremity 26 of the rib 18. The lower side 27 of the detent blends into the lower side 28 of the rib, and the upper side of the detent 29 slopes back to its extremity substantially flush with the edge 19 of the upstanding flange 17.

Figure 3:
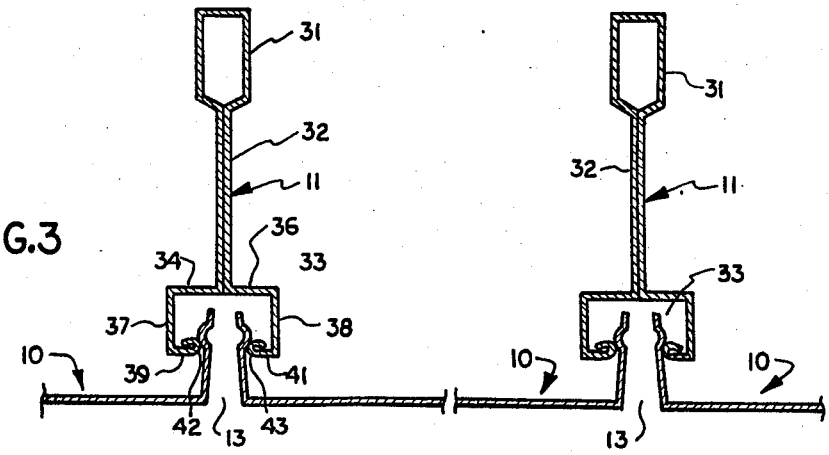
FIG. 3 is a fragmentary cross section, illustrating adjacent grid runners with snap-up panels in accordance with this invention installed thereon.

The illustrated panel is intended for installation in grids 11 having a cross section as best illustrated in FIG. 3. Such grids provide a stiffening bulb 31 along their upper edge, a central web 32 extending downwardly from the bulb 31, and a downwardly open channel 33 extending along the lower edge of the web 31. Such channel is defined by oppositely extending flanges 34 and 36, spaced and parallel depending side walls 37 and 38, and inturned lips 39 and 41. The inner edges of the lips 39 and 41 are hemmed and extend to inner extremities 42 and 43, respectively. Such extremities 42 and 43 are spaced apart and cooperate to define a downwardly directed opening extending the length of the channels 33.

The pans or panels 10 are installed in the grid by inserting the upstanding flanges 17 up along the associated inturned lips 39 and 41 until the ribs 18 are positioned immediately above the inner extremities of the associated lip. Since the panel is formed of sheet metal which is somewhat resilient, the panel deflects slightly from its unstressed position as it passes the associated inturned lip and then returns substantially to its unstressed condition, so that the extremities or inner edges 41 and 43 of the associated lips extend under the rib and provide support for the panel along substantially the entire periphery of the panel.

As discussed above, there is a tendency for the inturned lips to spread a small amount during the manufacturing thereof adjacent to at least one end of each runner. Therefore, full support of the panel adjacent to the end of the runner which opens up slightly adjacent to its end may not be properly provided along the full length of the runner. If the depth of the rib is increased to provide full support under such circumstances, the interlocking connection between the panels and the runners tends to become excessive and it is difficult to remove the panel without causing damaging distortion to the panel. Further, if the panel is sized so that adequate support is provided even in the zones adjacent to the ends of the runners where spreading occurs, the flanges cannot snap back to their substantially unstressed condition, and stresses are transmitted down along the flanges to the central portions 16, causing a distortion therein which produces an undesirable waviness in the panels which is sometimes referred to as "oil canning."

With the present invention, however, the panels are sized so that the flanges return to a substantially unstressed condition when the panels are installed and such oil-canning or waviness in the central portion of the panel is avoided. Further, the ribs are sized so that excessive forces are not required to remove the panel when access is required in the zone above the ceiling. The detents, however, because they extend inwardly beyond the extremities of the rib, provide a greater overlap adjacent to the corners so that proper support is assured even at locations adjacent to the corner, where the spacing between the inturned lips tends to increase.

In the illustrated embodiment, the detents are preferably located immediately adjacent to the notch 22. When a removal tool is positioned within a notch to pull the panel down off the grid, the removal force is applied substantially adjacent to the detent, and permanent deformation of the panel does not occur during such removal. Further, since the detents do not extend along the length of the ribs to any substantial extent, they do not drastically increase the interlocking action between the panel and the grid, so intallation and removal of the panel are not difficult.

Sufficient interlocking is provided so that the panel does not fall from its installed position even when substantial weight is applied to the panel. For example, it is customary to locate insulation over such panels and, on occasion, moisture collects in the installation and creates a significant weight on the panel.

In one embodiment that is provided with satisfactory support, the extremity 26 of the rib is located about 0.065 inch from the adjacent outer face of the panel and the extremity 24 of the detent extends about 0.095 inch beyond the extremity 26 of the rib.

Figure 4:
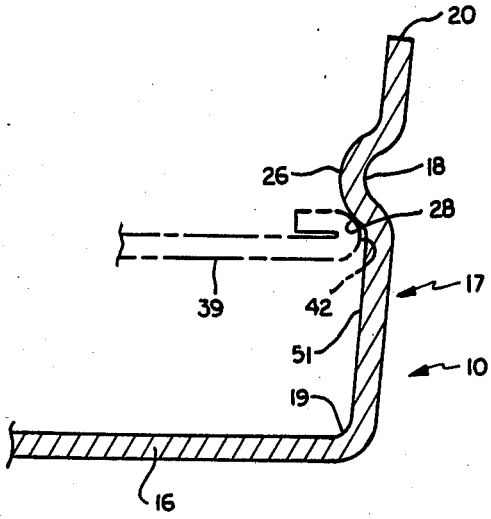
FIG. 4 is an enlarged, fragmentary section, taken along line 4—4 of FIG. 2, illustrating in phantom the manner in which an installed panel is supported along its sides by an associated lip of a grid illustrated in FIG. 2.
Figure 5:
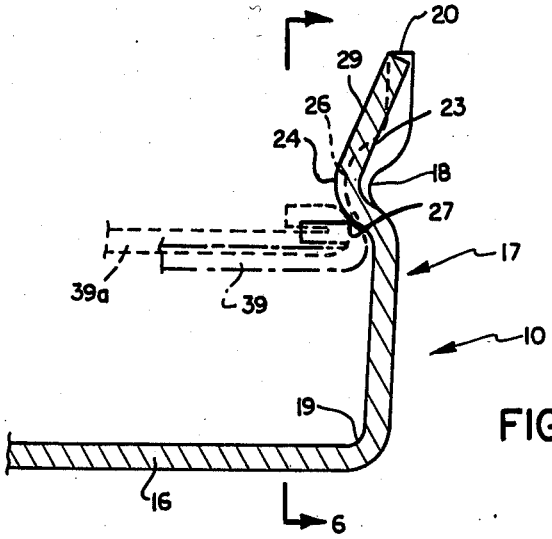
FIG. 5 is an enlarged, fragmentary section similar to FIG. 4, taken along line 5—5 of FIG. 2.
Figure 6:
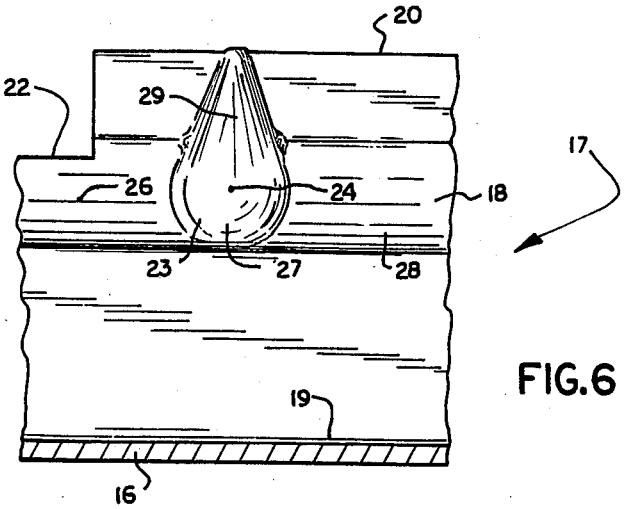
FIG. 6 is an enlarged, fragmentary view, taken along line 6—6 of FIG. 5.

Preferably, the panel is sized so that the edge 42 of the adjacent lip 39 or 41, as the case may be, extends beyond the inner extremity 26 of the rib so that the lower surface 28 of the rib rests on the adjacent lip, as best illustrated in FIG. 4. In such condition, there is a small spacing between the inner edge of the lip and the inner wall 51 of the upstanding flange so that flange is not distorted from its unstressed condition. This is the optimum support condition illustrated in FIG. 4. When the lips 39 and 41, however, spread apart a condition can occur, as illustrated in FIG. 5, in which the lip **39*a* will not extend beyond the inner extremity 26 of the rib and will, therefore, not provide support adjacent to the corners. In such instance, however, proper support is provided because the lip illustrated at 39*a* still extends inwardly beyond the inner extremity 24** of the detent to provide localized support for the corners of the pan.

It has also been determined in actual practice that better alignment between adjacent panels is provided when the panels are provided with detents. Consequently, the spaces 13 of an installed array of panels are better aligned and provide a better visible appearance to the ceiling structure. This improved alignment is also provided when the grid is out-of-square to a limited extent.

In practice, the panels are formed from sheet metal which is die-cut to exact size, with dies that also simultaneously form the ribs and detents. In a second operation, the flanges 17 are formed to the upstanding position in forming dies which produce panels to relatively close tolerances. However, greater tolerances can be accommodated while still producing a commercially satisfactory panel when a rib and detent system as illustrated is provided.

Although the preferred embodiment of this invention has been shown and described, it should be understood that various modifications and rearrangements of the parts may be resorted to without departing from the scope of the invention as disclosed and claimed herein.

What is claimed is:

1. A snap-up pan for installation in suspension ceiling grids formed of runners intersecting to provide openings surrounded by lips, comprising sheet metal providing a planar portion and laterally extending flanges surrounding said planar portion, said flanges providing a rib therein extending lengthwise of the associated flange, and detents substantially adjacent to the ends of each flange aligned with said ribs, said detents extending laterally with respect to said flanges in the same direction as said ribs beyond the extremities thereof, the lower side of said detents blending into the lower side of the associated of said ribs, said ribs and detents being operable to snap over adjacent of said lips to support said pans on said adjacent lips in said opening, said detents being operable to provide a supporting connection with said lips which compensates for variations in spacing between said lips adjacent to the corners of said openings.

2. A snap-up pan as set forth in claim 1, wherein said ribs extend substantially the entire length of the associated of said flanges, and the upper sides of said detents slope toward said flanges above the upper sides of said rib.

3. A snap-up pan as set forth in claim 2, wherein said ribs and detents extend in a direction toward the opposite of said flanges.

4. A snap-up pan as set forth in claim 2, wherein said ribs and detents are spaced from said planar portion.

5. A snap-up pan as set forth in claim 2, wherein said flanges provide tool receiving means adjacent said detents operable to receive a tool for removing installed pans from a suspension ceiling grid.

6. A snap-up pan as set forth in claim 1, wherein said detents have a length in the direction of said flanges at least substantially as small as their lateral extent substantially perpendicular to the associated of said flanges.

7. A suspension ceiling comprising a grid formed of interconnecting runners cooperating to define polygonal openings surrounded by horizontally extending lips, snap-up pans in said openings supported by said lips, said pans providing a polygonal central portion surrounded by opposed upwardly extending flanges, said flanges providing a rib therein extending lengthwise of the associated flanges, and detents substantially adjacent to the ends of each flange aligned with said ribs, said detents extending laterally with respect to said flanges in the same direction as said ribs beyond the extremities thereof, the lower side of said detents blending into the lower sides of the associated of said ribs, said detents and ribs extending over said lips to removably support said snap-up pans in said openings, said detents providing a supporting connection with said lips which compensates for variations in the spacing between said lips adjacent to the corners of said openings.

8. A suspension ceiling as set forth in claim 7, wherein said grid runners provide an open channel along the lower edge thereof, said lips of each of said grids being spaced from each other and extending toward each other along the lower edge of said channel, adjacent of said flanges of adjacent panels extending into said channel between said lips of said runners.

9. A suspension ceiling as set forth in claim 8, wherein said flanges provide tool receiving means adjacent to said detents operable to receive a tool for removing installed pans from said grid.

* * * * *